US006955572B1

(12) United States Patent
Howell

(10) Patent No.: US 6,955,572 B1
(45) Date of Patent: Oct. 18, 2005

(54) LGA CONTACT WITH EXTENDED ARM FOR IC CONNECTOR

(75) Inventor: David G. Howell, Gilbert, AZ (US)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/898,137

(22) Filed: Jul. 22, 2004

(51) Int. Cl.[7] ..... H01R 4/48
(52) U.S. Cl. ..... 439/862
(58) Field of Search ..... 439/862, 342, 439/83, 876, 733.1, 74, 66

(56) References Cited

U.S. PATENT DOCUMENTS 5,350,322 A * 9/1994 Kondo ..... 439/862
5,685,748 A * 11/1997 Harting et al. ..... 439/862
5,711,690 A * 1/1998 Thrush et al. ..... 439/862
5,980,323 A * 11/1999 Bricaud et al. ..... 439/630
5,984,693 A 11/1999 McHugh et al.
6,113,440 A * 9/2000 Fijten et al. ..... 439/862
6,231,394 B1 * 5/2001 Schnell et al. ..... 439/630
6,652,329 B1 * 11/2003 Howell et al. ..... 439/862
6,752,635 B1 6/2004 Searls et al.

* cited by examiner

*Primary Examiner*—Gary Paumen
*Assistant Examiner*—Phuongchi Nguyen
(74) *Attorney, Agent, or Firm*—Wei Te Chung

(57) ABSTRACT

An LGA contact (40, 40') for electrically connecting an IC package (32, 32') and a PCB (34, 34') includes a vertical basic part (42 and 44, 42' and 44'), a vertical section (43, 43') bendedly outwardly extending from a lateral side of the vertical basic part, an arm (48, 48') extending upwardly from a top of said vertical section and a contacting portion (49, 49') extending from an distal end of the arm. The arm has a rearwardly extending portion (482, 482') and a forwardly extending portion (480, 480'). Further, two projections of the vertical section and the vertical basic part on a horizontal surface form an acute angle therebetween, thereby the arm can be devised to be relatively long to get good spring characteristics and many of this kind of contacts can be arranged in a relative less pitch as being assembled a housing (50, 50').

6 Claims, 7 Drawing Sheets

LGA CONTACT WITH EXTENDED ARM FOR IC CONNECTOR

BACKGROUND OF THE INVENTION

1. Field of the Invention

The present invention relates to electrical connectors and, more specifically to a contact planted on a dielectric housing of an electrical connector adapted to electrically mate an integral circuit (IC) package such as a central processing unit (CPU), with an electrical substrate such as a printed circuit board (PCB), wherein the contact is configured to have a long spring arm to improve spring characteristics thereof.

2. Description of the Prior Art

With the development of the connector industry toward the miniaturized, high-density and more reliable trends, generally, terminals or contacts secured on connectors, especially certain connectors used for electrically interconnecting an IC package, especially an land grid array (LGA) package with high-density leads or pads thereon with a PCB, are configured to be tiny and arranged in a high-density manner, e.g. a rectangular array, to catch up with the trends. This typically leads a problem, e.g. how to maintain good reliable electrical characteristics of the terminals or contacts of the connectors under these conditions.

One key factor to the above problem is focused on good normal force of the terminals or contacts which has direct and great effect on performance of the terminals or contacts. Except for material properties of the terminals or contacts, configuration or structures of the terminals or contacts play the important role in effecting normal force. Accordingly, optimized structures or configurations are increasingly becoming the useful and important weapon for manufacturers to prevail the connector market. Many ways to get better structures or configurations for the terminals of contacts have been invented so far.

One advanced way is disclosed in U.S. Pat. No. 5,984,693, assigned to Hon Hai who is also the assignee of the present invention. In this way, an LGA contact has a plate-like retention portion and a curved arm upwardly extending from a lower portion of the retention portion. An upright section is formed at an upper end of the arm, for electrically engaging a corresponding conductive pad of a CPU chip. With this configuration of the contact, the contact can have a relatively long arm, thereby facilitating improvement of contact characteristics thereof, namely, gaining good normal force.

However, the curved arm is disposed substantially within a corresponding contact-receiving passageway of a dielectric housing. Further, the arm has two main sub-arms extended in a horizontal direction vertical to a main surface of the retention portion. That is, the longer the arm is, the wider the horizontal projection of the arm becomes. Anyway, this will directly elongate a pitch of two adjacent contact-receiving passageways standing in a contact-receiving passageway row, thereby blocking the development of the contacts arranged in the housing toward the high-density trend.

Except for the above disadvantage, the upright section has an arc top surface with a topmost line left to electrically engage a bottom surface of the pad. When the contact mates with the chip, the upright section will be deflected aside. This is prone to result in engagement of only a point of the topmost line with the bottom surface of the pad. Thus, mating performance between the pad and the contact is liable to be in an inferior position.

In view of the above, it is strongly desired to provide a new LGA contact which overcomes the above-mentioned disadvantages.

SUMMARY OF THE INVENTION

Accordingly, an object of the present invention is to provide a new LGA contact able to be configured to have a relatively long elastic arm.

Another object of the present invention is to provide a new LGA contact for an electrical connector, wherein many of this kind of contacts can be planted in a housing of the connector in a relatively less pitch.

Still another object of the present invention is to provide a new LGA contact for electrical connector, wherein the contact can assure reliable electrical engagement between the contact and an electrical device mounted on the electrical connector.

To fulfill the above-mentioned objects, a new LGA contact provided according to the present invention comprises a vertical basic part for being secured on a cell defined in a housing of an electrical connector, a vertical section extending bendedly and outwardly from a lateral side of the vertical basic part, an elastic arm extending upwardly from a top of said vertical section and a contacting portion being connected to the arm and adapted for electrically engaging a conductive member of an IC package. When said vertical section and the vertical basic part are projected on a horizontal surface, a projection of said vertical section is orientated at an acute angle relative to a projection of the vertical basic part, thereby the arm can be devised to be relatively long. After many of this kind of contacts are assembled on the housing, a pitch between two adjacent contacts standing a same line can be relatively short. Thereby, good spring characteristics of the contact are gained to assure electrical engagement between the contact and the conductive member and a density of arrangement of the contacts on the housing is high.

An improvement of the above contact is to configure the arm of the contact to have a rearwardly extending portion and a forwardly extending portion. With this configuration of the arm, the arm can be further longer.

Another improvement of the above contact is to make the arm further comprise a straight middle portion between the rearwardly extending portion and the forwardly extending portion, thereby also further elongating the arm.

Still another improvement of the above contact is to design the contacting portion to have a curved configuration with a curved mating surface, thereby the curved mating surface can have different parts thereof alternatively engaged with the conductive member. This decreases the risk of damaging to the conductive member or/and the contacting portion during moving of the contacting portion relative to the conductive member.

Furthermore, another improvement of the above contact is to dispose a part of the arm of the contact outside the housing as being assembled on the housing, thereby the arm can not be restricted by a space of the cell. Thus, the arm can be devised to be longer again.

Other objects, advantages and novel features of the present invention will become more apparent from the following detailed description when taken in conjunction with the accompanying drawings.

BRIEF DESCRIPTION OF THE DRAWINGS

The features of the present invention which are believed to novel are set forth with particularity in the appended claims. The invention, together with its objects and the advantages thereof, may be best understood by reference to the following detailed description taken in conjunction with the accompanying drawings, in which like reference numerals identify like elements and in which:

DESCRIPTION OF PREFERRED EMBODIMENTS OF THE INVENTION

Reference will now be made to the drawings to describe the present invention in detail.

Figure 1:
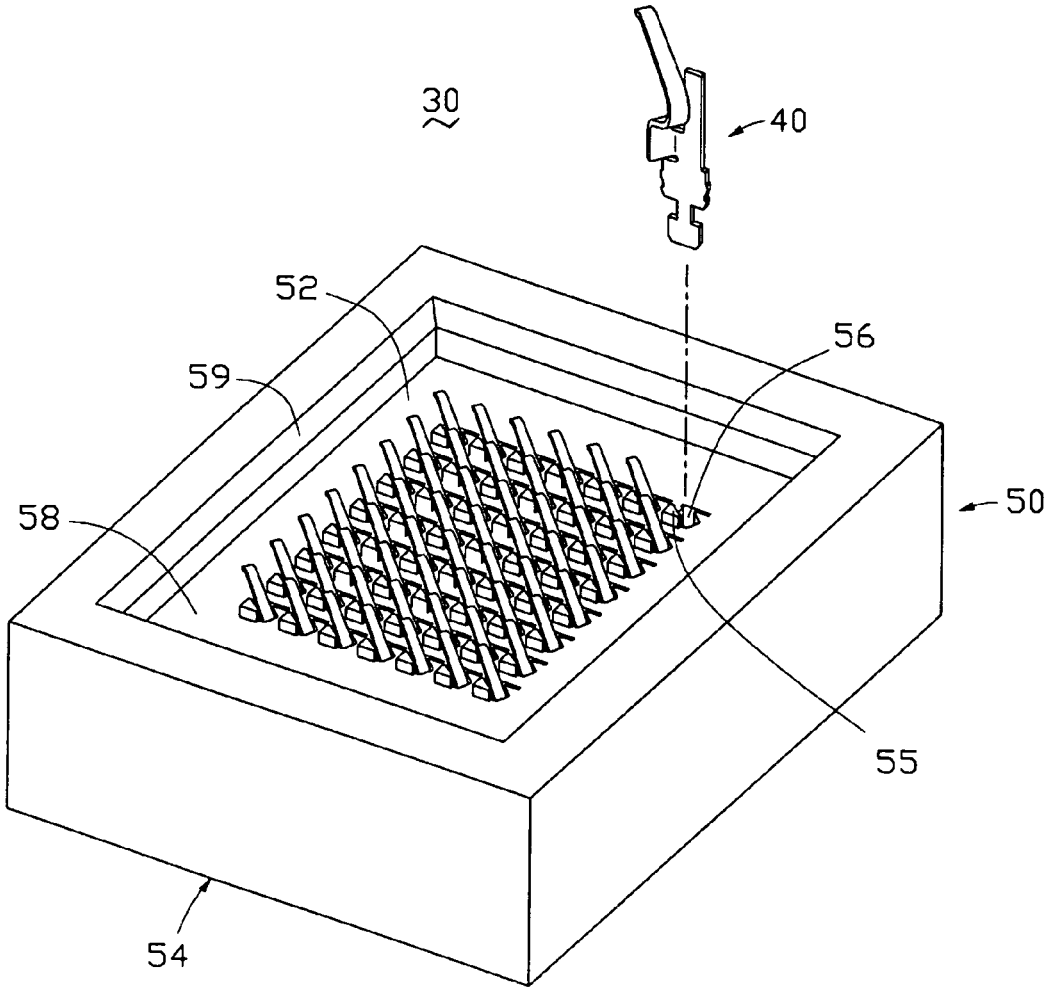
FIG. 1 is an isometric view of an electrical connector comprising a simplified housing and LGA contacts according to a first embodiment of the present invention, showing one contact extracted out from the housing.

Referring to FIG. 1, an electrical connector 30 has a plurality of conductive LGA contacts 40 according to a first preferred embodiment of the present invention, and a simplified dielectric housing 50 shaped to cater for the contacts 40. The electrical connector 30 is mainly used to electrically connect two electrical components, e.g. an IC package 32 and a PCB 34 (referring to FIG. 7, hereinafter detailed), but not limited thereto.

The housing 50 is formed from dielectric material and defines a horizontal top surface 52 and a bottom surface 54 opposite and parallel to the top surface 52. A plurality of cavities 56 is defined in the housing 50 between the top surface 52 and the bottom surface 54 and arranged in rows and columns, for receiving corresponding contacts 40 therein. Further, an opening 58 is defined in a center of a top of the housing 50 above the cavities 56 and in communication therewith, for receiving the IC package 32. It is appreciated that the opening 58 should have the same profile configuration as the IC package 32. Guiding slant surfaces 59 are formed on the housing 50 around a top mouth of the opening 58, for facilitating insertion of the IC package 32 into the opening 58.

Figure 2:
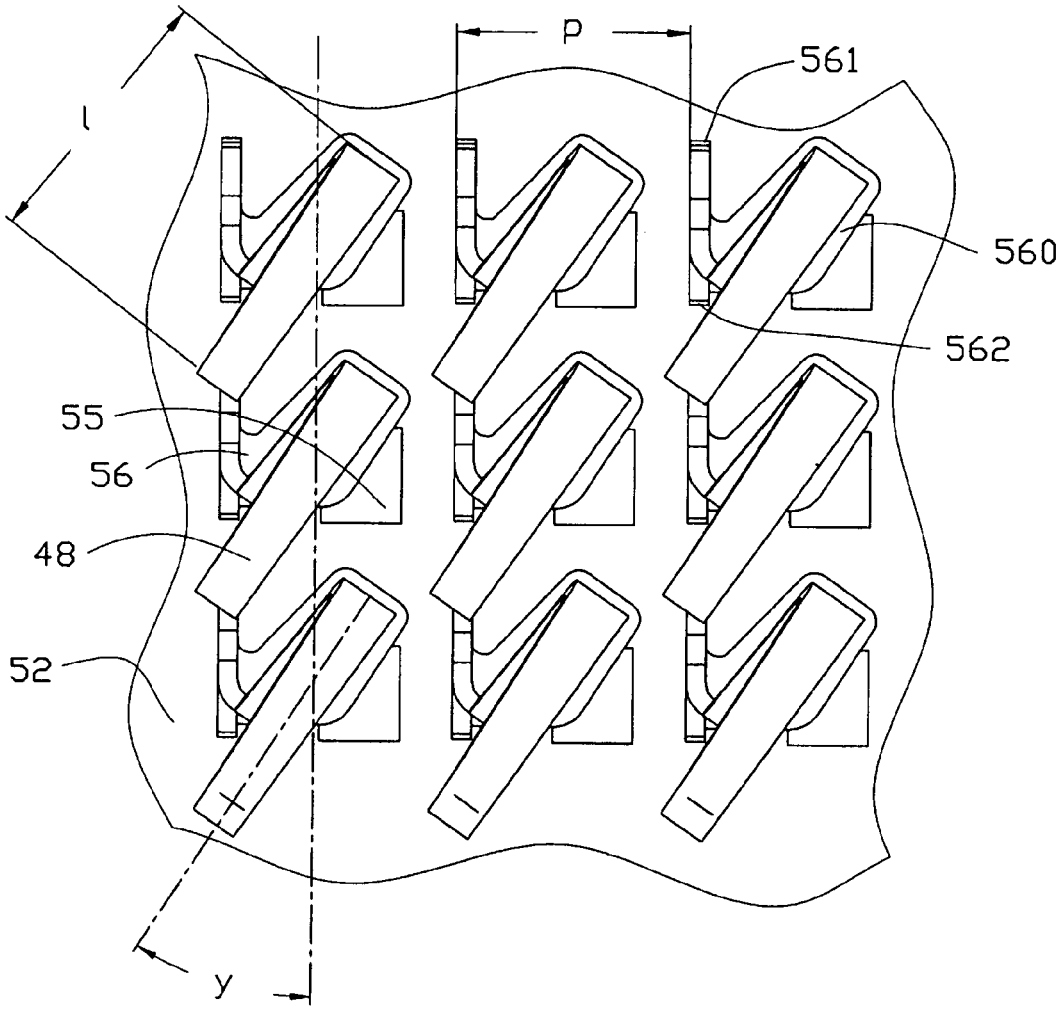
FIG. 2 is a part and top view of the connector of FIG. 1.

Referring also to FIG. 2, each cavity 56 has a vertical polygonal chamber 560 and a pair of lower vertical rectangular slots 561, 562 located one side of the chamber 560 and being in communication with the chamber 560. The chamber 560 has a bottom wall 564 with a bottom recess 566 (referring to FIG. 6). The slots 561, 562 extend through the housing 50 and cooperatively facilitate vertical insertion of a corresponding contact 40 into the cavity 56 from a top of the housing 50. It is appreciated that the chamber 560 and the slots 562, 562' can have other shapes or configurations, depending on various specific conditions under which the electrical connector 30 is used.

A plurality of protrusions 55 is formed on the housing 50, projecting upright above the top surface 52 of the housing 50. The protrusions 55 have a common mounting surface 550 adapted to engagingly mount or support the IC package 32. In the first preferred embodiment, each protrusion 55 is located adjacent a corresponding cavity, and has a substantially right-angle trapezium-like cross-section, but is not limited thereto. The protrusion 55 may have other shapes or configurations, e.g. parallelepiped configuration, step-like projection and so on, provided that those kinds of protrusions 55 can each provide the mounting surface 550 and avoid intervening the contacts 40.

In order to facilitate being precisely sited on the PCB 34, several standoffs (not shown) are provided on the bottom surface 54, thereby spacing the bottom surface 54 of the housing 50 a pre-determined interval from a top surface of the PCB 34. Said interval can supply a space enough to position soldering balls 36 therein (referring to FIG. 9).

Figure 3:
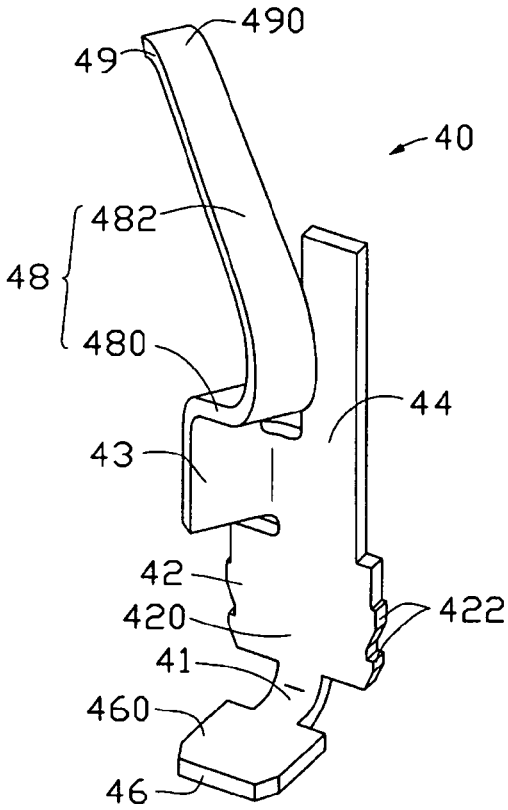
FIG. 3 is an isometric view of the contact of FIG. 1, but showing a tail of the contact being bent.
Figure 4:
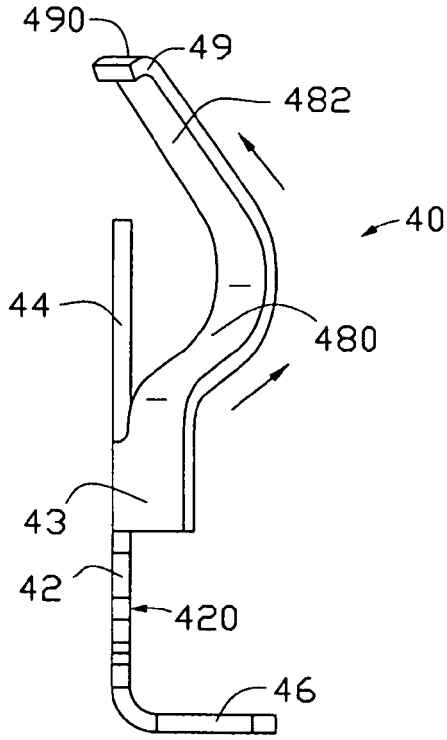
FIG. 4 is a front elevation view of the contact of FIG. 3.
Figure 5:
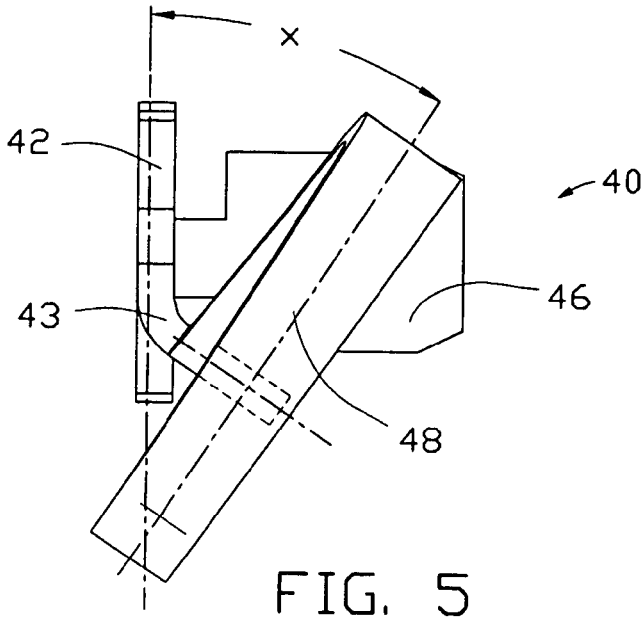
FIG. 5 is a top view of the contact shown in FIG. 3.

Referring also to FIGS. 3 to 5, each contact 40 in light of the first embodiment of the present invention is formed from conductive material and has a vertical plate-like base 42 with a major vertical surface 420. A plurality of barbs 422 is formed on opposite lateral sides of the base 42, for being engagingly received in corresponding slots 561, 562 of the housing 50.

For more securable position of the contact 40 in a corresponding cavity 56, an upright rectangular plate-like head 44 coplanarly projecting from a top end of the base 42, for being secured in the slot 562. It should be understood that the head 44 can be configured to have other configurations if it can be fixed in the slot 562.

A tail 46 is connected to a bottom end of the base 42, having a vertical position with respect to the base 42. The tail 46 has a relatively larger bottom surface 460 vertical to the major surface 420 of the base 42 and adapted to engage a solder member, e.g. solder ball 36, thereby establishing electrical engagement between the contact and the PCB 34 (best seen in FIG. 7).

A connecting neck 41 is provided to connect the tail 46 and the base 42. Since the neck 41 has a configuration relatively narrower or smaller than those of the tail 46 and the base 42, it is easy to be bent. This decreases the risk of damage to the tail 41 or the base 42 during forming the vertical position between the base 42 and the tail 41.

A vertical side limb 43 is bent or extended from a lateral edge of the head 44 at an obtuse angle, adjacent the base 42. It is also clearly understood that the limb 43 has an obtuse angle relationship relative to the major surface 420 of the base 42 or the head 44.

An arm 48 extends upwardly from a top end of the limb 43. To make the arm 48 longer, the arm 48 is devised to have a curved configuration with an upwardly and rearwardly extending lower portion 480 stemming from the top end of the limb 43 along a direction sl, and an upwardly and forwardly extending upper portion 482 originating from a distal end of the lower portion 480 along another direction s2.

The contact 40 further has an arced or curved peak 49 formed at a topmost part thereof with its distal end facing downwardly. The peak 49 is formed at a distal end of the arm 48 and has an arced or curved upper surface 490 for electrically engagingly mating with a corresponding conductive pad 320 of the IC package 32. From a top view of the contact 40, a projection of the arm 48 extends at an acute angle x with respect to a projection of the base 42 and is located at opposite sides of a projection of the limb 43 (best shown in FIG. 4).

With the configuration of the contact 40, the arm 48 extends in a curve way and is devised to make the good use of a space of a corresponding cavity 56, thereby the arm 48 can be relatively long.

Figure 6:
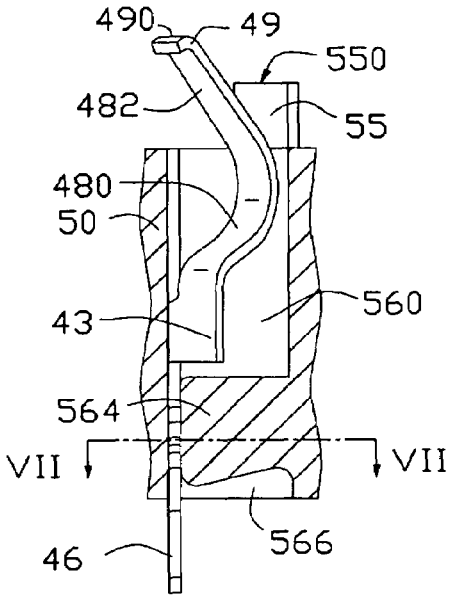
FIG. 6 is a cross section view of the connector, with one contact being just inserted into a corresponding cavity.
Figure 7:
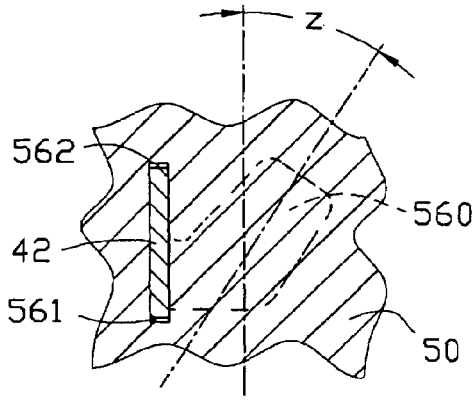
FIG. 7 is a cross section view along a line VII—VII in FIG. 6.
Figure 8:
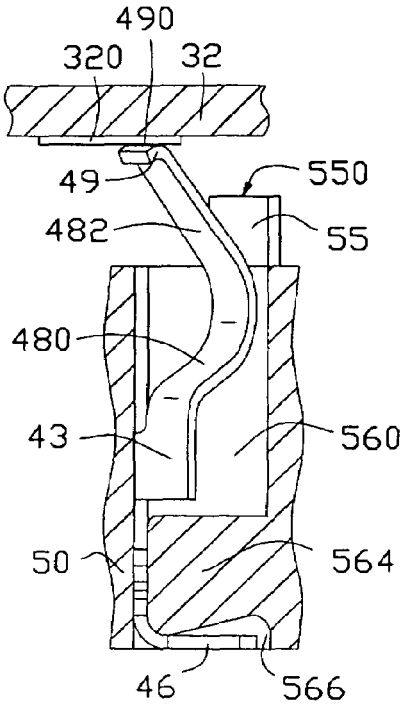
FIG. 8 is similar to FIG. 7, but showing the tail of the contact bent and an IC package placed just on the contact and ready to be pressed to engage the contact.

Referring to FIGS. 6 to 8, In assembly, the contact 40 is loaded from a top of the housing 50 into a corresponding cavity 56, with the tail 46 going through the slots 561, 562 of the cavity 56. Until the barbs 422 of the base 42 are fully and engagingly received in the slots 561, 562, the contact 40 is securely planted in the cavity 56. The head 44 of the contact 40 has a part thereof accommodated in the slot 562, thereby further positioning the contact 40 in the cavity 56.

After assembly, the arm 48 has an upper part of the upwardly and forwardly extending upper portion 482 projected beyond the top surface 52 of the housing 50 and above the mounting surface 550 of the protrusions 55. The raised peak 49 is at a topmost position of the contact 40 in an upright direction vertical to the top surface 52 or the mounting surface 550, and ready to electrically engage a corresponding pad 320 of the chip 32. The tail 46 is then vertically bent to be received in the bottom recess 566 of the housing 50. Thus, the contact 40 is completely planted on the housing 50.

With this arrangement design of the contact 40 in the cavity 56, the arm 48 is extended beyond the top surface 52 of the housing 50 and hence is not restricted by the space of the cavity 56. Therefore, the arm 48 can also be devised to be relatively long.

Referring also to FIG. 2, further, since the projection of the limb 43 has the acute angle relationship with the major surface 420 of the base 42, a projection of the head 44 or the projection of the base 42, from a top view of the connector 30, this leads the projection of the arm 48 at an acute angle γ with respect to a row direction e, the projection of the base 42 or the projection of the head 44. It is preferred that the projection of the arm 48 extends along a direction between the projections of two adjacent arms 48. Moreover, a length 1 of the projection of the arm 48 is longer than a pith p of two contacts 40 standing in said row direction. Thereby, the arm 48 can be devised to be longer and all the contacts 40 can be arrayed in a relatively short pitch, but there is no interference between the arms 48 of two adjacent contacts 40 standing in said row during being pressed down in use. Again, the arm 48 can be elongated, thereby gaining better elastics characteristic.

Figure 9:
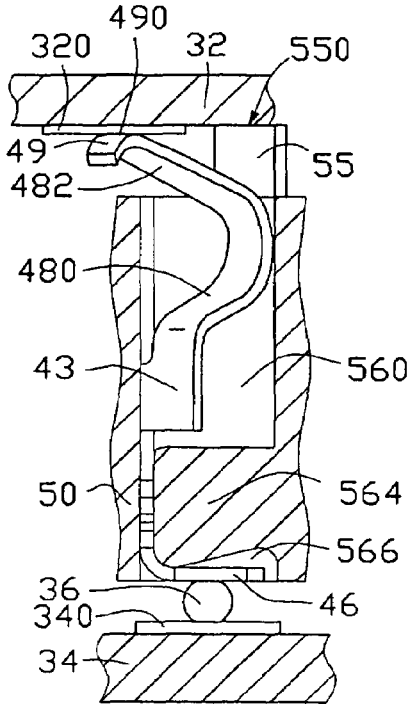
FIG. 9 is similar to FIG. 8, but showing the IC package engaging with the contact and tail of the contact being attached to a PCB via a soldering ball.
Figure 10:
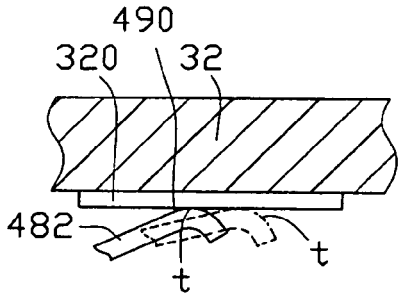
FIG. 10 is a phantom view of a peak of the contact engaging with the IC package.

Referring also to FIGS. 9 and 10, in use, the IC package 32 is placed into the opening 58 of the housing 50, with each pad 320 the of the IC package 32 seating on the peak 49 of a corresponding contact 40. It is appreciated that a heat sink (not shown) is provided on the IC package 32 to dissipate heat generated from the IC package 32 during its work, and a fixture mechanism (not shown) is provided to assemble the connector 30, the IC package 32 and the heat sink together and supply a urging means to press the IC package 32 to engage the connector 30.

When the IC package 32 is pressed down, the pad 320 has a bottom surface pressed the peak 49 of the contact 40 to urge the arm 48 of the contact 40 to resiliently deform down. Because the contact 40 has the above-described arm 48 and good resilient characteristics, a good normal force can be gained to assure good engagement between the pad 320 and the contact 40. During said pressing of the IC package 32, the upwardly and rearwardly extending portion 480 and the upwardly and forwardly extending portion 482 deform downwardly to generate spring force. Said spring force assures engagement between the peak 49 and the pad 320.

During deforming of the contact 40, with the arced or curved configuration of the upper surface 490 of the peak 49, the upper surface 490 has different parts alternatively engaged with corresponding different parts of the bottom surface of the pad 320. This manner can decrease friction between the peak 49 and the pad 320 and hence decrease the risk of damaging to the pad 320 or/and the contact 40 by friction force generated from engagingly sliding of the peak 49 relative to the bottom surface of the pad 320.

Figure 11:
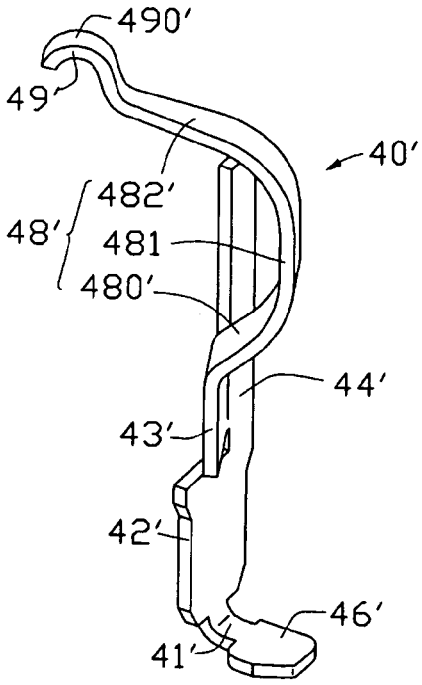
FIG. 11 is an isometric view of another LGA contact according to a second embodiment of the present invention.
Figure 12:
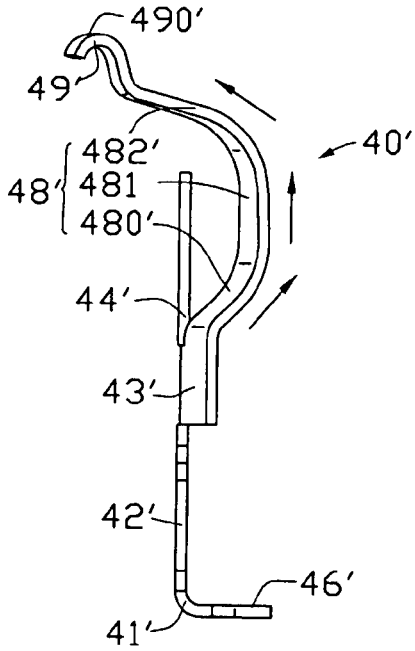
FIG. 12 is a front elevation view of the contact of FIG. 11.
Figure 13:
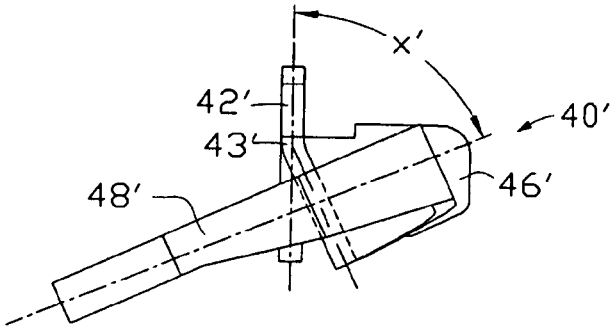
FIG. 13 is a top view of the contact shown in FIG. 11.

FIGS. 11 to 13 show another LGA contact 40' according to a second preferred embodiment of the present invention and a part of a dielectric simplified housing 50' adapted to receive the contact 40'. The contact 40' is similar to the contact 40 of the first embodiment, and also includes the same parts, e.g. a tail 46', a neck 41', a base 42', a head 44', a limb 43', an arm 48' including an upwardly and rearwardly extending portion 480 and an upwardly and forwardly extending portion 482, and a peak 49' as the contact 40.

Similar to the configuration of the contact 40, from a top view of the contact 40', a projection of the arm 48' extends at an acute angle x' relative to a projection of the base 42'. A projection of the limb 43' has the acute angle relationship with a major surface 420' of the base 42', a projection of the head 44' or the projection of the base 42', from a top view of the connector 30'. This leads the projection of the arm 48 at an acute angle y' with respect to a row direction, the projection of the base 42' or the projection of the head 44'. Moreover, a length l' of the projection of the arm 48 is longer than a pith p' of two contacts 40' standing in said row. Thereby, the arm 48' can also be devised to be longer and all the contacts 40' can be arrayed in the housing 50' in a relatively short pitch therebetween, but there is no interference between the arms 48' of two adjacent contacts 40' standing in said row during being pressed down in use.

Figure 14:
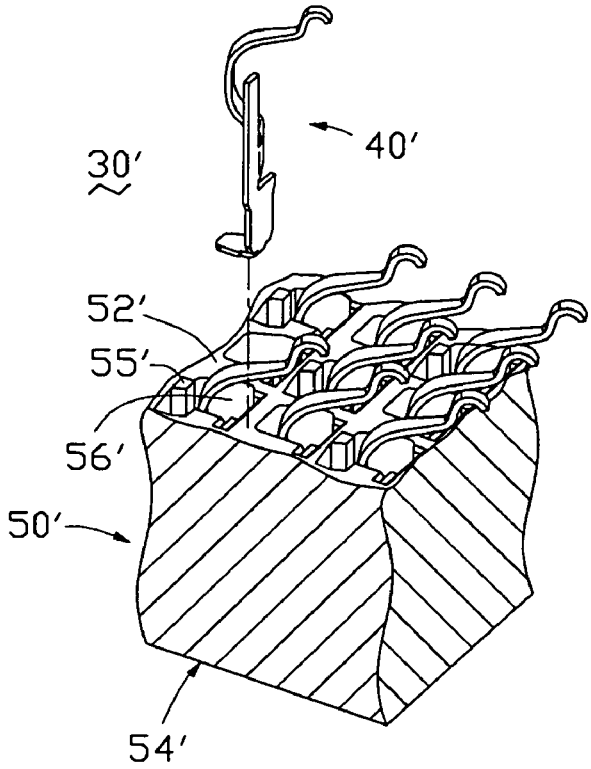
FIG. 14 is a part and isometric view of another electrical connector comprising a housing and contacts same to one of FIG. 11.
Figure 15:
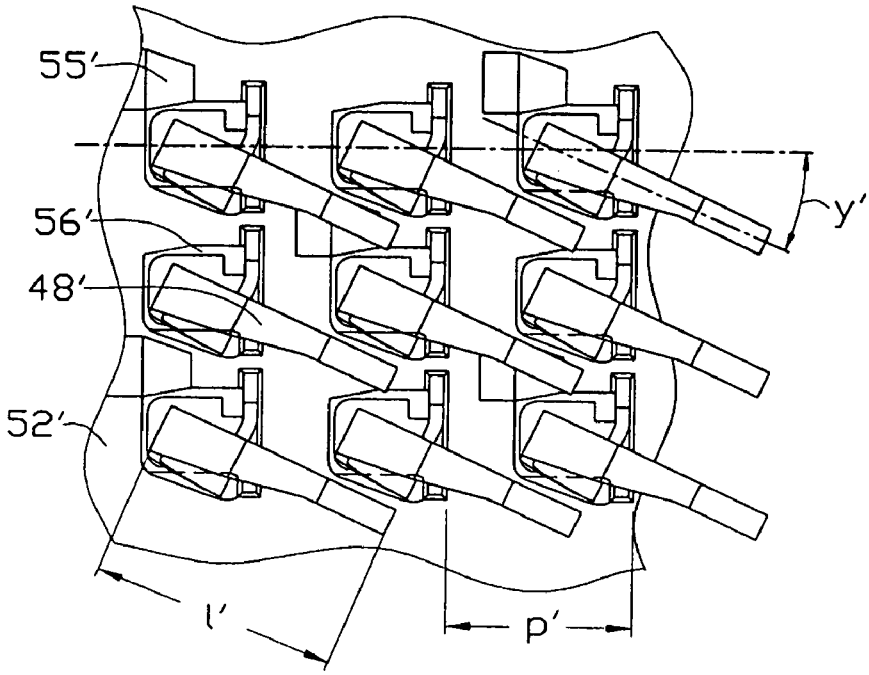
FIG. 15 is a top view of the connector shown in FIG. 14.

Referring to FIGS. 14 and 15, similar to the housing 50 of the first embodiment, the housing 50' defines a top surface' and a bottom surface 54'. A plurality of cavities 56' is defined in housing 50' between the top surface 52' and the bottom surface 54'. A plurality of protrusions 55' is formed on the top surface 52', thereby forming a common horizontal mounting surface 550' for supporting an IC package 32'. However, the protrusions 55' are only located around the cavities 56' selectedly and uniformly arrayed in the housing 50'. The protrusions 55' can achieve the same result of the protrusions 55 of the first embodiment and be easily and economically gained.

Furthermore, the contact 40' and the housing 50' have some improved points.

Referring to FIGS. 11 to 13, 19 and 20, in order to get the arm 48' of the contact 40' longer, the contact 40' further has an upright middle part 481 between its upwardly and rearwardly extending portion 480' and upwardly and forwardly extending portion 482'. The peak 49' of the contact 40' is further curved, thereby an upper surface 490' of the peak 49' has more parts, e.g. t', alternatively engaged with the bottom surface of the pad 320' of the IC package 32' during the arm 48' being pressed down. Thereby, the friction force generated from engagingly moving of the peak 49' relative to the bottom surface of the pad 320' is further decreased and the engaging procedure of the peak 49' and the pad 320' is more secure.

Referring to FIGS. 14 to 19, the contact 40' is placed into a corresponding cavity 56' from a top of the housing 50'. But, the cavity 56' of the housing 50' has a configuration different from the cavity 56 of the housing 50. The cavity 56' has a chamber 560' and slots 561', 562' extended through the housing 50'. Before the contact 40' is placed into the cavity 56', the tail 46' of the contact can be bent beforehand. Thus, all the contacts 40' can be bent at the same time when the contact 40' is still attached to a contact strip (not shown). This increases assembly efficiency of the connector 30' and bending uniform accuracy of the tails 46' of all the contacts 40'. After being assembled on the housing 50', the tails 46' is electrically connected to a pad 340' of a PCB 34' via a soldering ball 36'.

Figure 16:
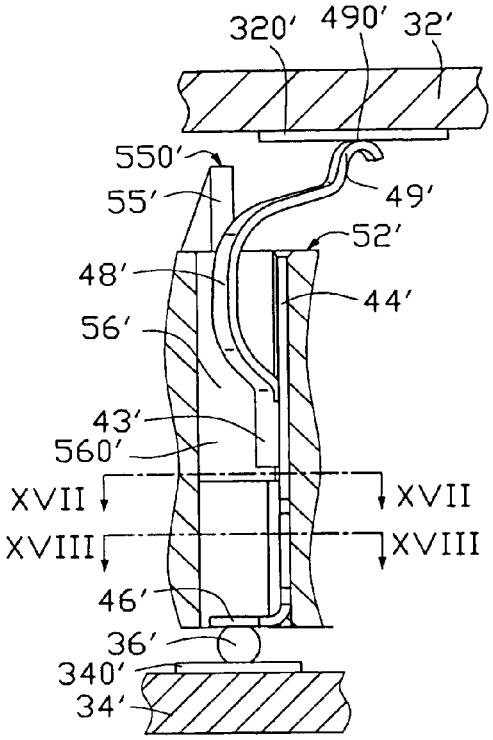
FIG. 16 is a cross section view of the connector of FIG. 14, with one contact being just inserted into a corresponding cavity of the housing, an IC package just placed on the contact and ready to be pressed to engage therewith and a PCB attached to the contact via a soldering ball.
Figure 19:
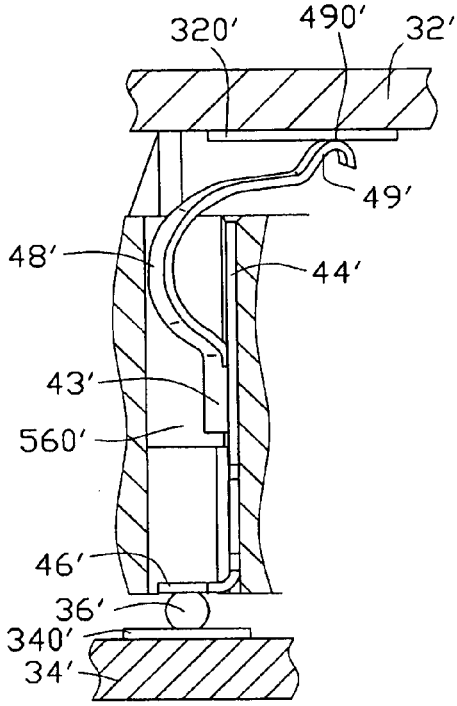
FIG. 19 is similar to FIG. 8, but showing the IC package engaging with the contact.
Figure 17:
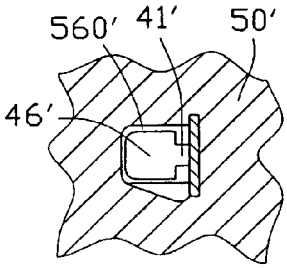
FIG. 17 is a cross section view of the connector along a line XVII—XVII in FIG. 16.
Figure 18:
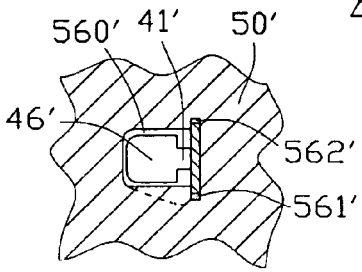
FIG. 18 is a cross section view of the connector along a line XVIII—XVIII in FIG. 16.
Figure 20:
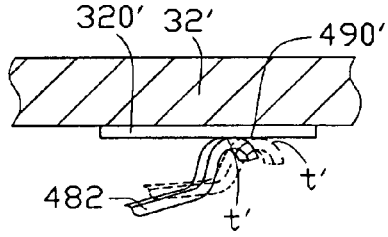
FIG. 20 is a phantom view of a peak of the contact of FIG. 16 engaging with the IC package of FIG. 16.

Referring to FIGS. 16, 19 and 20, the connector 30' shown in the second embodiment works in the same manner as stated above in connection with the connector 30 of the first embodiment.

Furthermore, although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an IC contact comprising a vertical basic part for being secured on a housing of an electrical connector; a lower portion extending downwardly from a lower end of the vertical basic part and being adapted for electrically engaging with an electrical component, a vertical section extending from the vertical basic part; an arm extending upwardly from said vertical section; and a contacting portion being connected to the arm and adapted for electrically engaging a conductive member of an IC package; wherein when said vertical section and the vertical basic part are projected on a horizontal surface, a projection of said vertical section is orientated at an acute angle relative to a projection of the vertical basic part, thereby facilitating elongating the arm;

wherein the arm comprises a rearwardly extending portion and a forwardly extending portion;

wherein the rearwardly extending portion extends upwardly and rearwardly from a top end of said vertical section and the forwardly extending portion extends upwardly and forwardly from a distal end of the rearwardly extending portion;

wherein a projection of the arm on the horizontal surface is at an acute angle with respect to the projection of the vertical basic part;

wherein a projection of the arm on the horizontal surface has a part thereof located at one side of the projection of said vertical section and another part thereof located at the other side of the projection of said vertical section;

wherein the contacting portion has a curved configuration with a curve mating surface for electrically engaging the conductive member;

a dielectric housing defining a top surface and a bottom surface and a plurality of contact receiving passageways between the top surface and the bottom surface, and a plurality of conductive contacts received in the passageways, respectively, each of the contacts has a middle part secured in a corresponding passageway, an elastically deformable upper portion extending from the passageway and above the top surface, and an engaging portion extending from the upper portion for electrically engaging an mating electrical device;

wherein when the upper portion and the middle part are projected on the top surface, a projection of the upper portion is orientated at an acute angle relative to a projection of the middle part;

wherein the contacting portion has a curved configuration with a curve mating surface for electrically engaging the electrical device;

wherein at least one projecting portion is formed on the housing above the top surface of the housing, said at least one projecting portion having a common surface to engagingly support the electrical device;

wherein the engaging portion extends above the common surface of said at least one projecting portion;

wherein said at least one projecting portion is arranged around corresponding passages, respectively;

wherein the upper portion further comprises a straight part between the rearwardly extending portion and the forwardly extending portion.

2. An IC connector for electrically interconnecting two electrical devices, a connector contact comprising:

a retention portion, an upper portion extending upwardly from an upper end the retention portion; a lower section being connected to a lower end of the retention portion; a side portion extending bendedly and outwardly from a lateral side of the upper portion; a elastically deformable curved arm extending upwardly from the side portion; and a head being connected to the arm;

wherein the contact further a neck between the retention portion and the lower section, the neck being narrower than either of the retention portion and the lower section;

wherein a plurality of barbs is formed on opposite lateral sides of the retention portion;

wherein the contacting portion has a curved configuration with a curve mating surface;

the connector comprising a housing defining a top surface and a plurality of passageways under the top surface, the passageways being arranged in rows and under the top surface; and a plurality of contacts received in the passageways, respectively, each contact comprising a part secured on the housing, an arm extending from the part beyond the top surface of the housing, a tail extending from the part toward one electrical device and an engaging portion extending from the arm and being adapted for electrically engaging with the other electrical device; wherein each of the arms of the contacts is projected on the top surface to form a projection which is orientated at an acute angle with respect to a row direction;

wherein the tail is eclectically attached to the one device via a soldering member;

wherein a neck is formed between the tail and the part and is narrower than either of the tail and the part;

wherein the arm comprises a rearwardly extending portion and a forwardly extending portion;

wherein the arm further comprises a vertical medial portion between the rearwardly extending portion and the forwardly extending portion;

wherein at least one projecting portion is formed on the housing above the top surface of the housing, said at least one projecting portion having a common surface to engagingly support the other electrical device;

wherein the engaging portion extends above the common surface of said at least one projecting portion;

wherein said at least one projecting portion is arranged around corresponding passageways, respectively.

3. An electrical contact assembly comprising contact for electrically engaging an electrical interface, a basic body; a tail extending downwardly from the vertical basic body and being adapted for electrically engaging with an electrical component; an elastic arm extending upwardly from basic body; and a mating portion being connected to an end of the arm and adapted for electrically engaging said electrical interface; wherein the mating portion is curved to have a curved mating face, when said electrical interface is urged to press the mating portion, the elastic arm deforms to make different parts of the curved mating face alternatively electrically engage the electrical interface;

wherein the arm extends from a lateral side of the body;

wherein the arm comprises a rearwardly extending portion and a forwardly extending portion;

wherein the arm further comprises a straight medial portion between the rearwardly extending portion and the forwardly extending portion;

wherein a neck between the retention portion and the lower section, the neck being narrower than either of the retention portion and the lower section;

a dielectric housing adapted for receiving a plurality of IC contacts each having a lower tail and an upper arm, the housing comprising a substantially plate-like body; a first surface being formed on a top of the body; a second surface being formed on a bottom of the surface; body opposite to the first a plurality of cavities being defined in the body between the first and the second surfaces, and at least one projection extending from the first surface a common predetermined height relative to the first surface to form a common face to engagingly support a mating electrical device, said at least one projection being arranged adjacent corresponding cavities, respectively; wherein each of said plurality of cavities comprises a narrow vertical section and a large vertical portion being in communication therebetween;

wherein said section is adapted to insert the tail of the contact therethrough and the body has a projecting portion defined in the said portion to separate said portion into an upper chamber and a bottom recess for being received the tail of the contact;

wherein said plurality of cavities is arranged in rows and said portion has a cross section with a center line orientated at an acute angle with respect to a row direction;

wherein said plurality of cavities is arranged in rows, and said portion is adapted to insert the tail of the contact therethrough and has a cross section with a center line orientated at an acute angle with respect to a row direction.

4. An electrical connector assembly comprising an electrical substrate with a plurality of conductive first members; an IC package with a plurality of conductive second members arranged thereon, a dielectric housing mounted on the substrate and being adapted to receive the IC package, the housing defining a top surface and a plurality of cells therein, the housing forming a plurality of projections above the top surface and being configured to have a common supporting surface; and a plurality of contacts received in the cells, respectively, the contacts each having an upper engaging portion extending outside the body and being adapted for electrically engaging a corresponding second conductive member and a lower engaging portion for electrically mating with a corresponding first conductive member, the contact further comprising an elastic middle part between said upper engaging portion and said lower engaging portion; wherein as the IC package is urged down along a direction vertical to the top surface to make each second conductive member engagingly press a corresponding upper engaging portion, the middle part of the second conductive member elastically deforms to let the IC package move down close the housing until the IC package is fully disposed on the housing with electrical engagement between the second conductive member and the upper engaging portion and the IC package being supported by the supporting surface of the housing, thereby the second conductive members is engaged with the upper engaging portions above the top surface of the housing;

wherein the second conductive member and the upper engaging portion have an inter-engaging area, said inter-engaging area having a projection on the top surface of the housing outside a peripheral of the cell in which the contact with the upper engaging portion is received;

wherein the arm comprises a rearwardly extending portion and a forwardly extending portion;

wherein the arm further comprises a straight medial portion between the rearwardly extending portion and the forwardly extending portion;

wherein the lower engaging portion is engaged with a corresponding first conductive member by an electrical soldering member;

wherein the plurality of projections is arranged adjacent corresponding passageways, respectively.

5. An electrical connector comprising an insulative housing defining a plurality of passageways extending in a vertical direction therein and a top face thereon; a plurality of contacts disposed in the corresponding passageways, respectively, each of the contacts defining a resilient arm extending from a middle portion of the contact, said resilient arm essentially extending initially from a first side of the corresponding passageway upwardly and obliquely and also toward an opposite second side thereof, and once almost reaching the second side, successively reversely extend from the second side to the first side upwardly and obliquely;

wherein a distal free end section of said resilient arm extends out of the corresponding passageway both horizontally and vertically;

wherein a tip of said resilient arm is located above the top face and essentially right above another passageway neighboring the corresponding passageway in which the contact is disposed;

wherein said first side and said second side are defined diagonally.

6. The connector as claimed in claim 5, wherein a plurality of projections are formed on the top face around the corresponding passageways, respectively, so that the two projections around the neighboring passageways defines a channel therebetween to receive the end section of the contact located in another passageway neighboring to one of said two neighboring passageways.

* * * * *